US005243757A

United States Patent [19]

Grabbe et al.

[11] Patent Number: 5,243,757

[45] Date of Patent: Sep. 14, 1993

[54] METHOD OF MAKING CONTACT SURFACE FOR CONTACT ELEMENT

[75] Inventors: Dimitry G. Grabbe, Middletown; Iosif Korsunsky, Harrisburg, both of Pa.

[73] Assignee: AMP Incorporated, Harrisburg, Pa.

[21] Appl. No.: 888,946

[22] Filed: May 26, 1992

Related U.S. Application Data

[62] Division of Ser. No. 730,769, Jul. 16, 1991, abandoned.

[51] Int. Cl.[5] ..... H01R 43/04

[52] U.S. Cl. ..... 29/882; 29/874; 29/883; 264/61; 439/71

[58] Field of Search ..... 29/830, 882, 874, 883; 264/61; 439/71

[56] References Cited

U.S. PATENT DOCUMENTS

Re. 32,370 3/1987 Bright .
3,927,841 12/1975 Iacobucci .
3,975,079 8/1976 Blakesley et al. .
4,657,325 4/1987 Marks .
4,755,146 7/1988 Rishworth et al. .
4,823,234 4/1989 Konishi et al. .
4,902,233 2/1990 Maillot .
4,969,828 11/1990 Bright et al. ..... 439/68

*Primary Examiner*—Carl J. Arbes
*Attorney, Agent, or Firm*—Bruce J. Wolstoncroft; Driscoll A. Nina, Jr.

[57] ABSTRACT

A miniature socket (10) for electrically interconnecting contact pads on a bare integrated circuit chip (16) to circuit pads (64) on a substrate (18) is disclosed. The socket includes a housing (12) and contact elements (14) having a diameter of about 0.003 inches. The housing (12) includes a recess (28) on one surface (30) for receiving the circuit chip (16) and cavities (44) on an opposite surface (38) for receiving the contact elements (14) and passages (56) leading to the recess (28) from the cavities (44) for receiving the pin sections (80) on the elements (14). Methods of forming a gold tip (84) on the pin sections (80) and for providing cavities (44) and passages (56) in the housing (12) are also disclosed.

15 Claims, 6 Drawing Sheets

METHOD OF MAKING CONTACT SURFACE FOR CONTACT ELEMENT

This application is a divisional of U.S. application Ser. No. 07/730,769 filed Jul. 16, 1991 now abandoned.

FIELD OF THE INVENTION

The invention disclosed herein relates to miniature sockets for use in burn-in and testing of bare integrated circuit chips.

BACKGROUND OF THE INVENTION

In the microelectronic industry, a continuously debated problem is that of burn-in and testing of bare; i.e., naked integrated circuit chips. As is well known, chips are mostly packaged by wire or tape bonding and encapsulated in a ceramic or plastic package.

Since the cost of packaging is higher in many cases than the cost of the chip, it makes more economic sense to burn-in naked chips so that those that are defective can be discarded and only the surviving good chips packaged. Also, the good chips can be sorted according to the test results prior to packaging.

The desire to burn-in naked chips led to the development of tape automated bonding (TAB) by General Electric in 1964. However the bonding tape as well as the TAB burn-in sockets have proven to be quite expensive. Thus there continues to be an acute need for a technological solution to the problem of burning-in and testing naked chips. Complicating the problem is the fact that contact pads positioned mostly on the perimeter of the chip are typically spaced as close as 0.004 inches (0.01016 cm) center to center, although the majority are spaced 0.006 inches (0.01524 cm) center to center. There is no technology in the field at this time to address such densities in sockets or connectors.

Accordingly, it is now proposed to provide a miniature socket having discrete contact elements for the burning-in of naked chips.

SUMMARY OF THE INVENTION

According to the present invention, a miniature socket is provided having a housing and wire or flat metal formed contact elements. The housing is provided with a recess in one surface for receiving a bare or naked integrated circuit chip and means in an opposite surface for receiving the contact elements and passages leading to the recess for pin sections on the contact elements for electrically engaging a chip in the recess. The contact elements further include leads extending out of the housing for electrically engaging circuit pads on a substrate.

DESCRIPTION OF THE INVENTION

Figure 1:
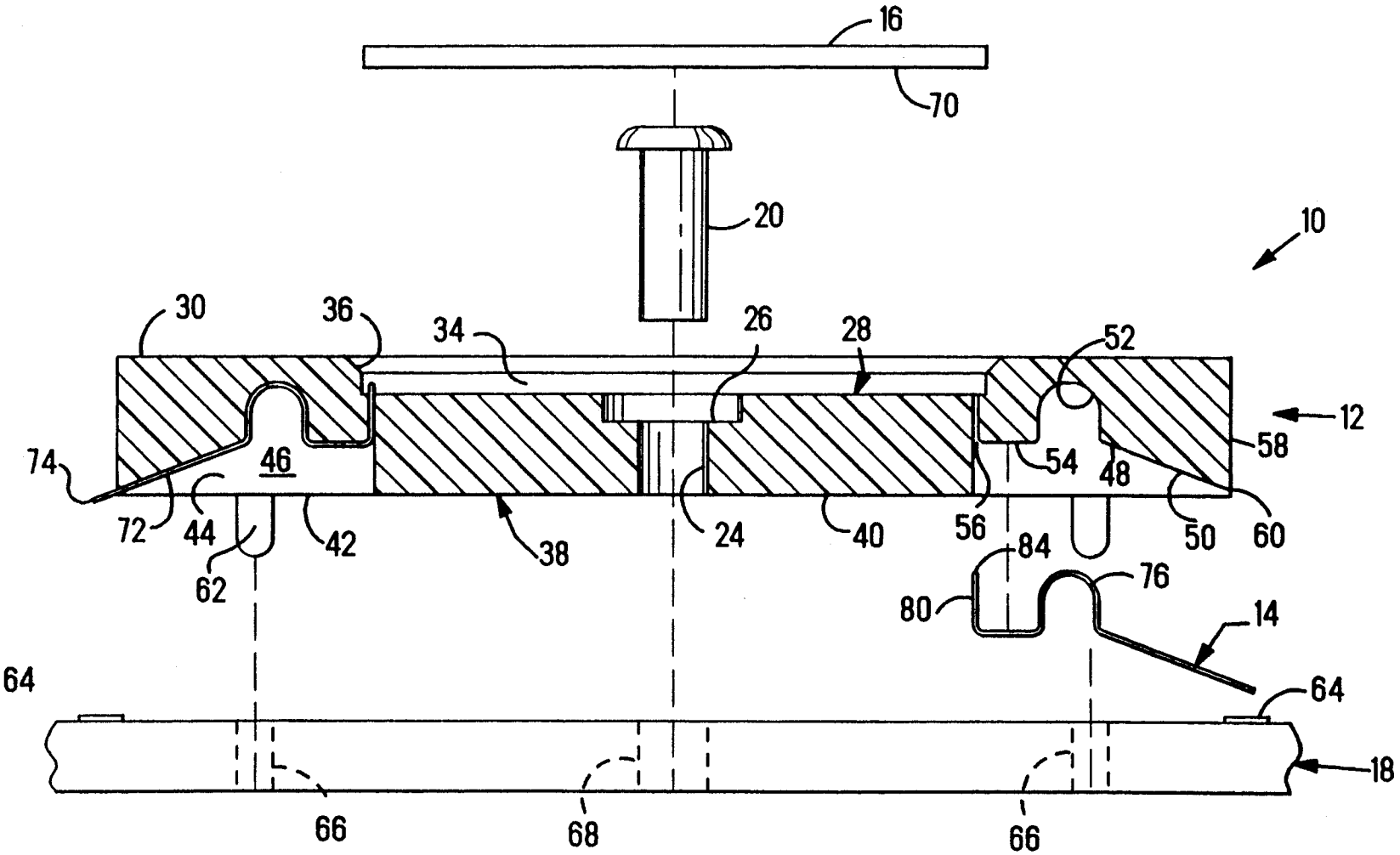
FIG. 1 is a sectioned, exploded side view of a socket according to the present invention.

FIG. 1 shows an exploded socket 10 of the present invention. Socket 10 includes housing 12 and contact elements 14. Also shown in FIG. 1 is a naked integrated circuit chip 16, substrate 18 and eyelet 20.

Figure 2:
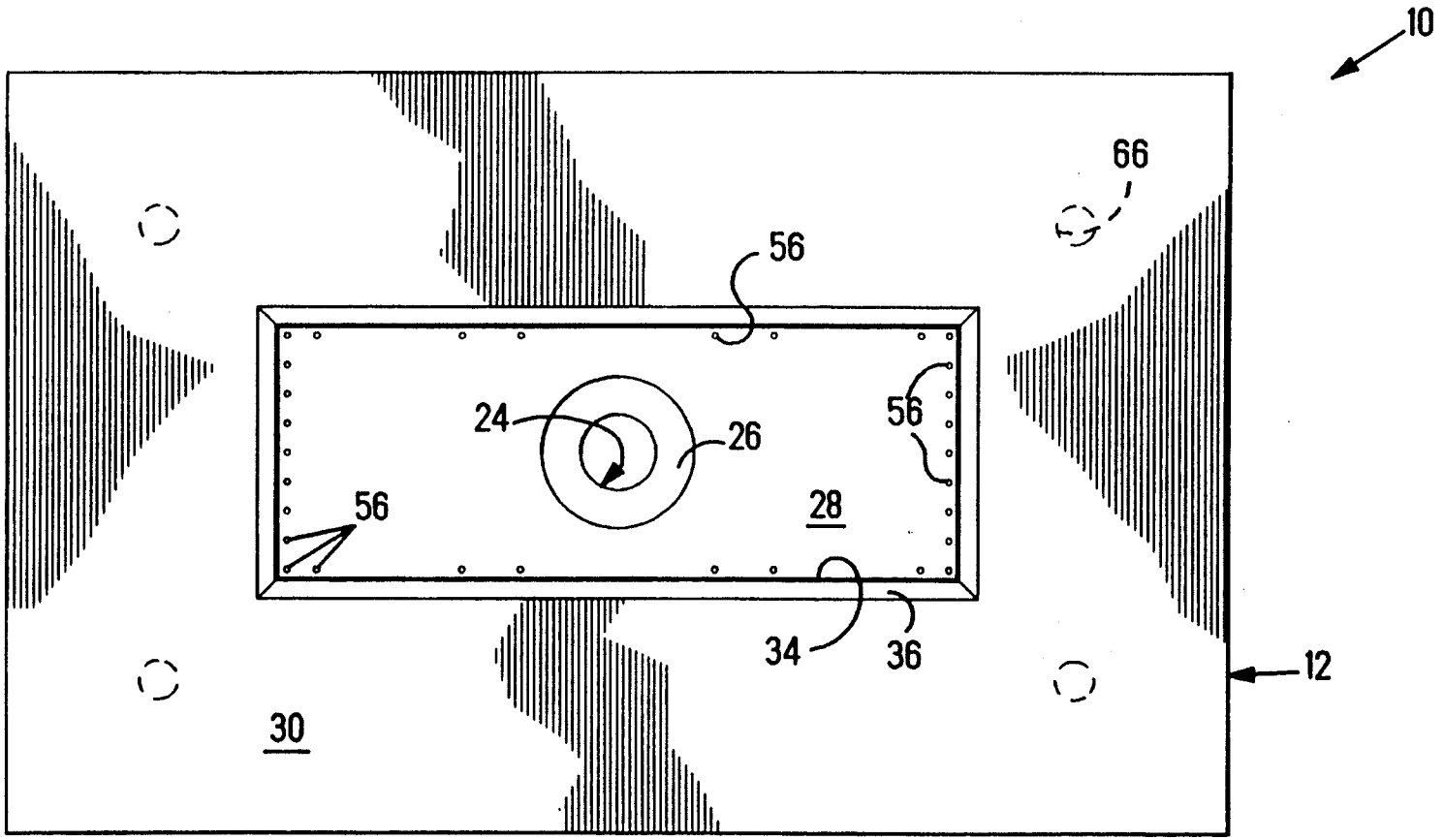
FIG. 2 is a top plan view of the socket.

With reference to FIGS. 1 and 2, rectangular shaped housing 12 is provided with a centrally located bore 24 having a counterbored portion to define outwardly facing annular shoulder 26. Further, an outwardly open, centrally located chip receiving recess 28 is provided in surface 30 of housing 12. A portion of the recess walls 34 are beveled, as indicated by reference numeral 36, to facilitate placing chip 16 into recess 28.

The under surface 38 of housing 12 includes a center area 40 and an outer area 42. In one embodiment, the outer area 42 is provided with a plurality of cavities 44 defined by intervening walls 46. Each cavity includes ceiling 48 having the profile shown; i.e., a slant surface 50, a U-shaped surface 52 and level surface 54. Passages 56, at the innermost margin of outer area 42, lead from cavities 44 to recess 28. Slant surfaces 50 intersect housing outer side walls 58 upwardly from surface 38 to provide gap 60.

Shallow grooves (not shown) may be provided if desired to aid in positioning elements 14. Two or more locating posts 62 depend from housing 12.

As shown in FIG. 1, substrate 18 is provided with circuit pads 64, locating holes 66 and a retaining hole 68.

Chips 16 have contact pads (not shown) on surface 70.

Figure 3B:
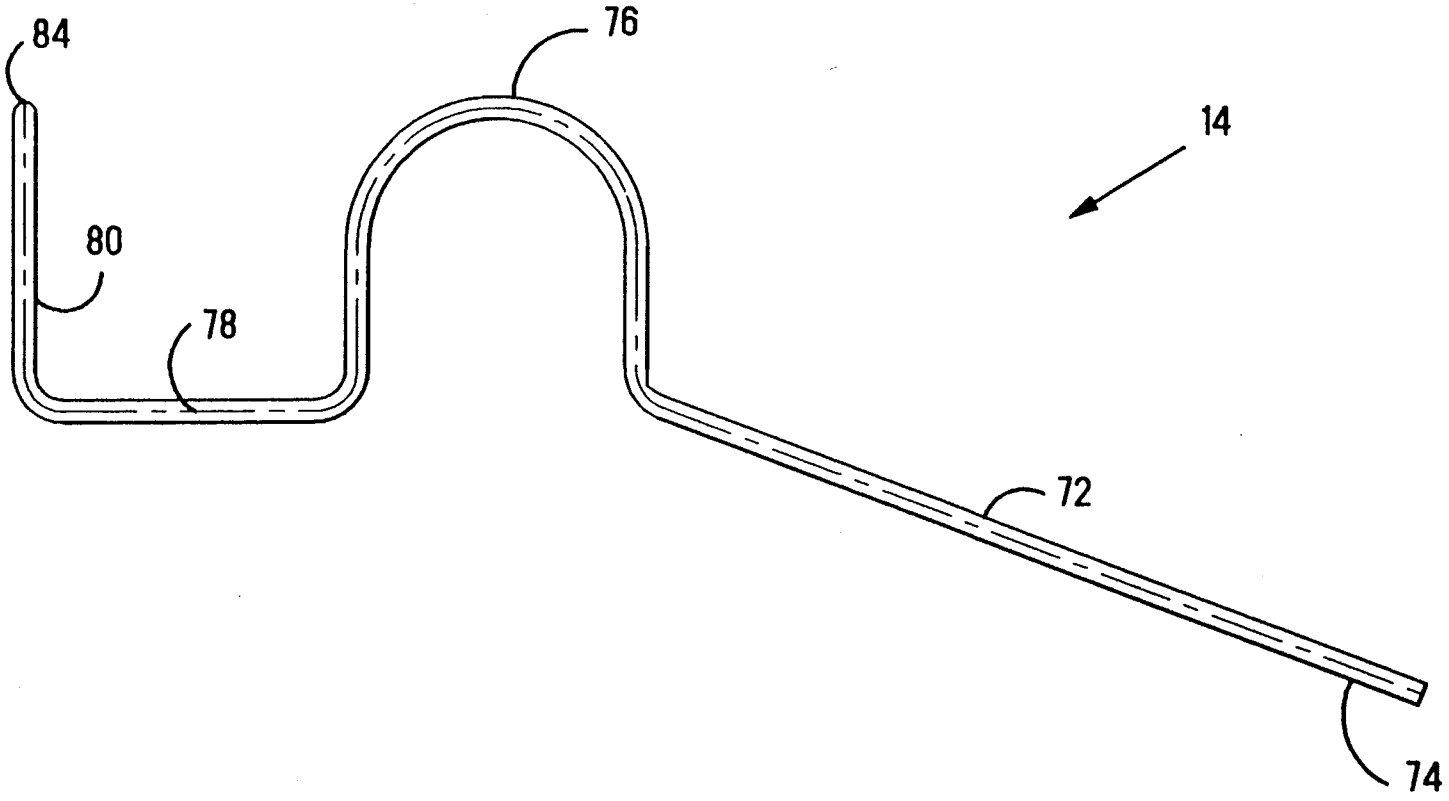
FIG. 3 is an enlarged view of a contact element of the present invention.

As shown in a larger scale in FIG. 3, contact element 14 has a shape complementary to the surfaces 44, 48, 52 and passage 54. The several sections of element 14 include an elongated lead 72 having free ends 74, U-shaped stabilizing section 76, intermediate section 78 and pin section 80.

Figure 4:
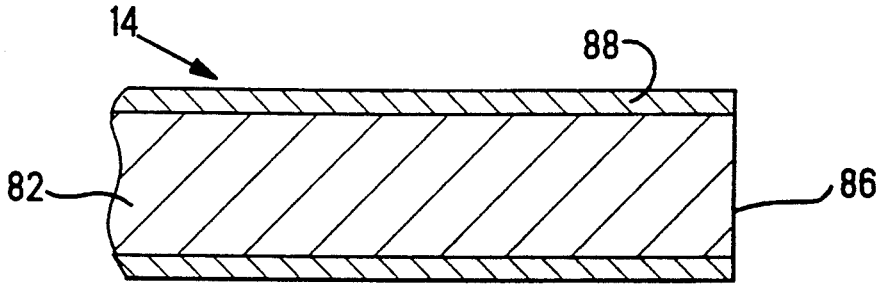
FIGS. 4, 5 and 6 are greatly magnified views showing the steps in forming a contact surface at one end of the contact element.

With reference to FIG. 4, elements 14 are formed from wire 82 having a diameter of about 0.003 inches (0.00762 cm) or from flat metal of similar shape and dimensions. A suitable wire material includes tungsten but other materials may be used. The wire may be preplated or post-forming plated, particularly where selective plating is desired. The preferred plating material is gold but other noble metals may also be used, as well as nickle-boron, which is frequently used for burn-in contacts.

Figure 5:
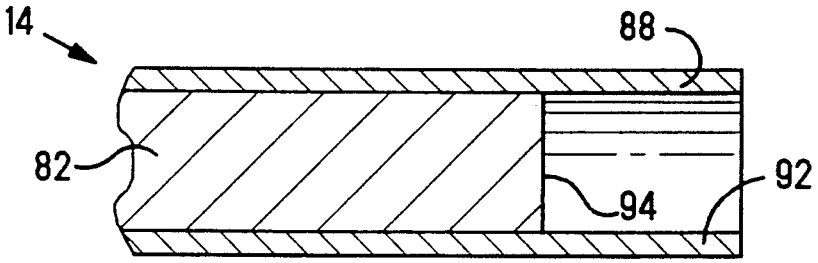
Figure 6:
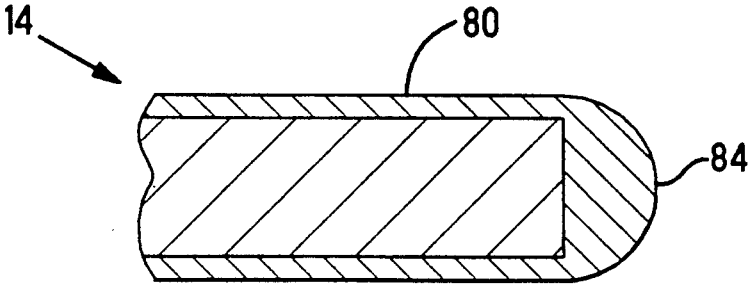

Pin section 80 and particularly the free end contact surface 84, shown greatly magnified in FIG. 6, includes a gold tip for enhanced electrical contact with the pads on chip 16. FIGS. 4, 5 and 6 illustrate one method of forming the gold tip.

FIG. 4 shows a free end 86 of element 14 with a plating 88 of gold. End 86 is subjected to being sprayed or emersed in an etching solution such as for example ferric chloride (not shown) which attacks the wire core but not the gold. End 86 would continue to be subjected to the solution until a pre-determined length of wire core 82 has been etched away; e.g. about 0.003 inches (0.00762 cm). Since the solution attacks only the wire core, a sleeve 92 of gold remains as shown in FIG. 5. Sleeve 92 can then be mechanically impacted to collapse it onto the new end 94 of wire 82 to form a relatively thick layer of gold (not shown). The rounded contact surface 84 shown in FIG. 6 can then be formed by laser fusing, hydrogen flaming, spark discharge or other means.

As shown on one side of the drawing in FIG. 1, contact element 14 is located conformably along the top wall 48 of cavity 44. Pin section 80 is located in passage 56 so that contact surface 84 thereon will extend into recess 28. Stabilization is provided by U-shaped section 76 being received in U-shaped surface 52 and retention by heat staking the element.

Figure 7:
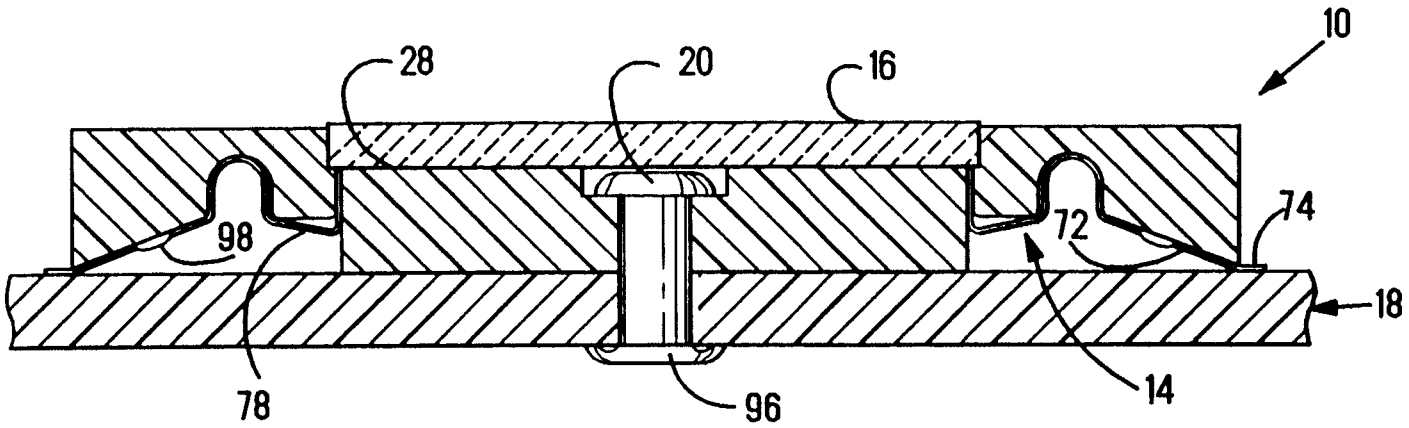
FIG. 7 is a sectioned side view of the socket mounted on a substrate and with a naked chip positioned in the socket.

FIG. 7 shows socket 10 mounted on substrate 18 and naked chip 16 in recess 28. Socket 10 is secured to substrate 18 by eyelet 20 passing through opening 24 and hole 68 and receiving a clinching member 96 therein. Posts 62, received in holes 66 locate socket 10 so that the free ends 74 of leads 72 extend out from cavities 44 through gaps 60 and on contact pads 64. Ends 74 may but do not have to be soldered onto pads 64.

As chip 16 is placed into recess 28 and biased therein by a retaining cover (not shown) or the like, electrical contact between the contact pads on chip 16 and contact surfaces 84 are established. The required normal force therebetween is provided by the chip 16 pushing down on pin sections 80, causing sections 76 and 78 of elements 14 to be resiliently deformed as shown.

Due to the positioning of contact pads 64 on substrate 18, it is necessary to fan out leads 72 on contact elements 14. Thus there is a need to populate housing 12 of socket 10 with elements 14 having varying length leads 72 as shown in FIG. 8.

Figure 8:
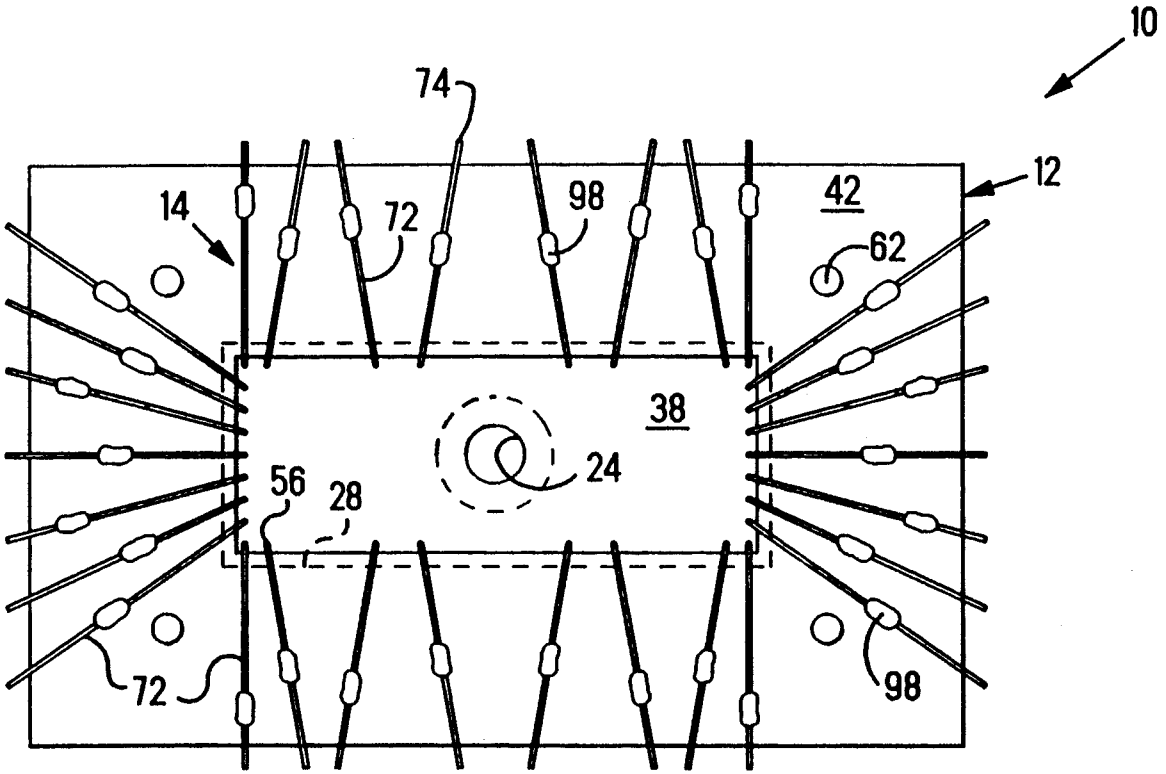
FIG. 8 is a bottom plan view of the socket.

FIG. 8 also shows heat staking element 14 onto ceiling 48 as one method of retention. The heat stake is indicated by reference numeral 98 in FIG. 8. Other conventional methods; e.g., using sealants or adhesives, may also be used.

As noted above, contact elements 14 are extremely small and difficult to work with. One method of providing the rounded gold contact surface 84 is to first load the elements 14 into housing 12 and then proceed to follow the procedure outlined above.

Similarly, passages 56 are extremely small and accuracy in locating them is paramount. Thus, it is proposed to mold the general shape of housing 12 and complete the configuration by cutting cavities 44 using laser cutting processes and mechanically drilling passages 56. Passages 56 may also be formed with a laser but with the current stat of the art, it is more difficult than drilling. Technology for these two processes exist now and are available. For example, the Dynamotion Company can drill holes as small as 0.002 inches and as deep as 20 diameters.

It will occur to those having ordinary skill in the art that socket 10 can be made differently than set forth above. For example, stabilization has been provided by a U-shaped section 76 being received in a complementary shaped surface 52 in cavity 44. Clearly the shape can be something other than a U to as effectively achieve the purpose of stabilizing a round wire. Similarly socket 10 may be made in two pieces with a frame providing a recess 28 as well as a carrier for the circuit chip. This would preclude handling the chip itself.

As can be discerned from the foregoing, a miniature socket for use in burn-in testing of naked chips has been disclosed. The socket includes a housing and contact elements having a diameter of about 0.003 inches. To accommodate elements of such small size, passages and cavities in the housing may be mechanically drilled or laser cut. The housing is provided with a recess for receiving the chip with the passages intersecting the recess from the cavities in which the contact elements are positioned.

We claim:

1. A method of forming a contact surface on a contact element, comprising the steps of:
   - forming a contact element having a diameter of about 0.003 inches, said element having a pin section at one end;
   - providing a plating of a noble metal on said pin section at a free end thereof;
   - recessing said free end back to provide a sleeve of said plating extending outwardly from said recessed free end;
   - collapsing said sleeve onto said recessed free end; and
   - compacting said collapsed sleeve into a rounded tip on said recessed free end.

2. The method of claim 1 wherein the step of forming a contact element includes forming said element from a wire.

3. The method of claim 1 wherein the step of forming a contact element includes forming said element from flat metal.

4. The method of claim 1 further including the step of loading said formed and plated contact elements into a socket housing before the step of recessing said free end.

5. A method of forming a contact surface on a contact element, comprising the steps of:
   - forming a contact element from a noble metal-plated conductive material with a pin section at one end having a free end;
   - recessing the conductive material core at said free end to provide a noble metal sleeve extending outwardly from a recessed free end;
   - collapsing said sleeve onto said recessed free end; and
   - forming said collapsed sleeve into a rounded tip.

6. The method of claim 5 wherein the step of forming a contact element includes forming said element from flat metal.

7. The method of claim 6 further including the step of forming the flat metal into a diameter of about 0.003 inches.

8. The method of claim 5 wherein the step of forming a contact element includes forming said element from a noble metal-plated wire.

9. The method of claim 8 wherein the diameter of said wire is about 0.003 inches.

10. The method of claim 8 wherein the step of forming a contact element includes forming said element from a gold plated wire.

11. The method of claim 5 wherein the steps of collapsing said sleeve and forming said collapsed sleeve into a rounded tip includes using hydrogen flame fusing.

12. The method of claim 5 wherein the steps of collapsing said sleeve and forming said collapsed sleeve into a rounded tip includes using spark discharge fusing.

13. The method of claim 5 wherein the steps of collapsing said sleeve and forming said collapsed sleeve into a rounded tip includes using laser fusing.

14. The method of claim 5 wherein the steps of collapsing said sleeve and forming said collapsed sleeve into a rounded tip includes using micro arc fusing.

15. The method of claim 5 wherein the step of recessing the conductive material core includes shearing the core and the steps of collapsing and forming include the use of fusing said sleeve.

* * * * *